US011466345B2

(12) United States Patent
Liu et al.

(10) Patent No.: US 11,466,345 B2
(45) Date of Patent: Oct. 11, 2022

(54) ALUMINUM ALLOY FOR CASTING AND METHOD OF FORMING A COMPONENT

(71) Applicant: GM GLOBAL TECHNOLOGY OPERATIONS LLC, Detroit, MI (US)

(72) Inventors: Zhongyi Liu, Troy, MI (US); Bin Hu, Shanghai (CN); James R. Salvador, Royal Oak, MI (US); Daad B. Haddad, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 369 days.

(21) Appl. No.: 16/512,936

(22) Filed: Jul. 16, 2019

(65) Prior Publication Data

US 2021/0017629 A1 Jan. 21, 2021

(51) Int. Cl.

| | |
|---|---|
| ***C22C 21/00*** | (2006.01) |
| ***C22F 1/02*** | (2006.01) |
| ***C22F 1/04*** | (2006.01) |
| ***B22D 7/00*** | (2006.01) |

(52) U.S. Cl.

CPC ..... *C22C 21/00* (2013.01); *B22D 7/005* (2013.01); *C22F 1/02* (2013.01); *C22F 1/04* (2013.01)

(58) Field of Classification Search

CPC . C22C 21/00; B22D 7/005; C22F 1/02; C22F 1/04

See application file for complete search history.

(56) References Cited

U.S. PATENT DOCUMENTS

2016/0145727 A1* 5/2016 Krishnamurthy ..... C22F 1/04 148/550

FOREIGN PATENT DOCUMENTS

CN 107245631 * 10/2001

OTHER PUBLICATIONS

Marker et al ("Phase equilibria and structural investigations in the system Al—Fe—Si", Intermetallics, Dec. 2011; 19(12):1919-1929) (Year: 2011).*

Guan et al ("Microstructure characteristics and stability in a rapidly solidified Al—Fe—Nb—Si alloy", J. Mater. Sci. Technol., vol. 13, 1997 ) (Year: 1997).*

Shakiba et al. ("Hot deformation behavior and rate-controlling mechanism in dilute Al—Fe—Si alloys with minor additions of Mn and Cu", Materials Science & Engineering A 636 (2015) 572-581) (Year: 2015).*

* cited by examiner

*Primary Examiner* — Robert S Jones, Jr.
*Assistant Examiner* — Jiangtian Xu
(74) *Attorney, Agent, or Firm* — Quinn IP Law

(57) ABSTRACT

An aluminum-iron alloy for casting includes aluminum, iron, silicon, and niobium present in the aluminum-iron alloy in an amount according to formula (I): $(Al_3Fe_2Si)_{1-x}$+x Nb, wherein x is from 0.25 parts by weight to 2.5 parts by weight based on 100 parts by weight of the aluminum-iron alloy. A method of forming a component including forming the aluminum-iron alloy is also described.

12 Claims, 2 Drawing Sheets

ALUMINUM ALLOY FOR CASTING AND METHOD OF FORMING A COMPONENT

INTRODUCTION

The disclosure relates to an aluminum-iron alloy and to a method of forming a component including the aluminum-iron alloy.

Components may be formed from castable metals and alloys and may require excellent durability and ductility. In addition, for some applications, such components may also be required to be lightweight and suitable for high temperature operating conditions.

SUMMARY

An aluminum-iron alloy for casting includes aluminum, iron, silicon, and niobium present in an amount according to formula (I): $(Al_3Fe_2Si)_{1-x}$+x Nb, wherein x is from 0.25 parts by weight to 2.5 parts by weight based on 100 parts by weight of the aluminum-iron alloy.

In one aspect, x may be from 0.5 parts by weight to 0.9 parts by weight based on 100 parts by weight of the aluminum-iron alloy.

In another aspect, x may be 0.5 parts by weight based on 100 parts by weight of the aluminum-iron alloy.

In a further aspect, x may be 0.9 parts by weight based on 100 parts by weight of the aluminum-iron alloy.

In yet another aspect, the aluminum-iron alloy may be a three-phase alloy and include an $Al_5Fe_2$ phase, a B2 phase, and a $\tau_{12}$ phase. The $\tau_{12}$ phase may be a main phase of the aluminum-iron alloy.

In one aspect, the aluminum-iron alloy may have a density of from 4.5 g/cm$^3$ to 5.5 g/cm$^3$. The aluminum-iron alloy may have a melting point of from 995° C. to 1,015° C.

In another aspect, the $Al_5Fe_2$ phase and the B2 phase may be secondary phases of the aluminum-iron alloy.

In a further aspect, an increased amount of niobium present in the aluminum-iron alloy may reduce an amount of the $Al_5Fe_2$ phase present in the aluminum-iron alloy.

In yet another aspect, the niobium may be present in the aluminum-iron alloy as a precipitate that surrounds the $\tau_{12}$ phase and suppresses nucleation and growth of the $Al_5Fe_2$ phase within the aluminum-iron alloy.

In one aspect, the aluminum-iron alloy may further include one or more of zirconium, molybdenum, tantalum, copper, zinc, and combinations thereof.

In another aspect, a component may be cast from the aluminum-iron alloy.

A method of forming a component includes forming an aluminum-iron alloy including aluminum, iron, silicon, and niobium according to formula (I): $(Al_3Fe_2Si)_{1-x}$+x Nb, wherein x is from 0.25 parts by weight to 2.5 parts by weight based on 100 parts by weight of the aluminum-iron alloy. The method also includes melting the aluminum-iron alloy to form a melt, solidifying the melt to form an ingot, and annealing the ingot. Concurrent to annealing, the method includes reducing a detrimental amount of a secondary phase of the aluminum-iron alloy. Concurrent to reducing, the method includes refining a grain structure of a main phase of the aluminum-iron alloy to thereby form the component.

In one aspect, forming the aluminum-iron alloy may include combining aluminum, iron, silicon, and niobium according to formula (I) such that x is from 0.5 parts by weight to 0.9 parts by weight based on 100 parts by weight of the aluminum-iron alloy.

In another aspect, melting may include heating the aluminum-iron alloy up to from 1,100° C. to 1,300° C. in one of air and an inert atmosphere.

In a further aspect, solidifying may include furnace cooling the melt.

In yet another aspect, solidifying may include air cooling the melt.

In one aspect, annealing may occur at from 800° C. to 1,000° C. for from 1 hour to 24 hours.

In another aspect, annealing may occur in one of a vacuum and an inert atmosphere.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
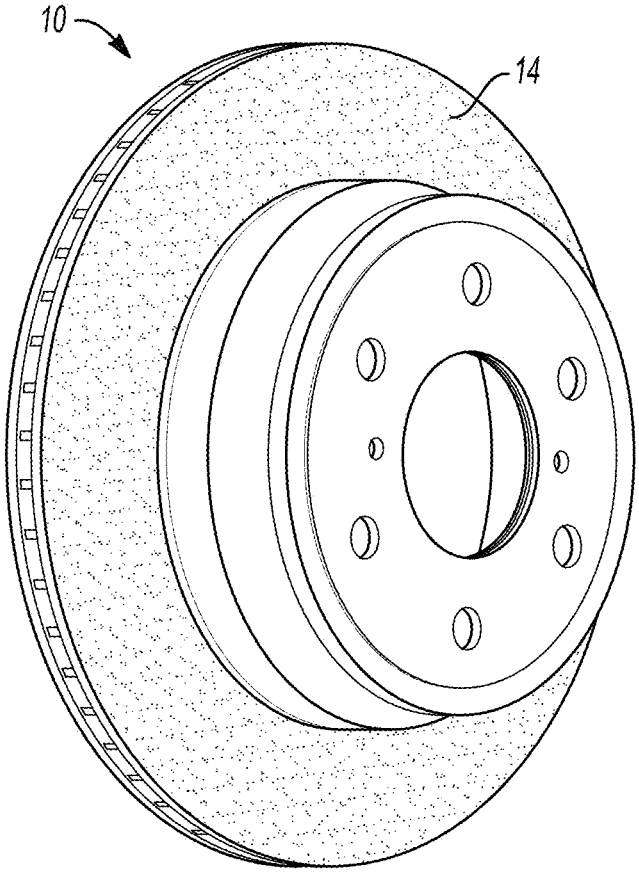
FIG. 1 is a schematic illustration of a perspective view of a component formed from an aluminum-iron alloy.
Figure 2:
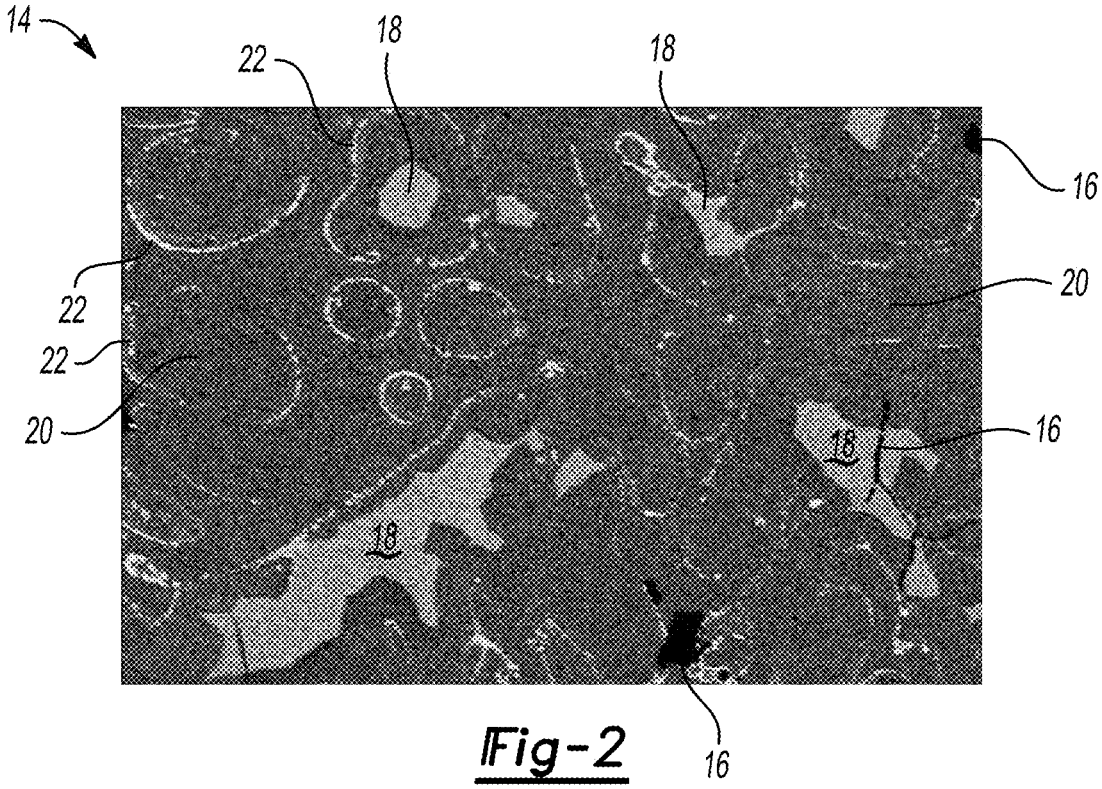
FIG. 2 is a scanning electron micrograph of a microstructure of the aluminum-iron alloy of the component of FIG. 1.
Figure 3:
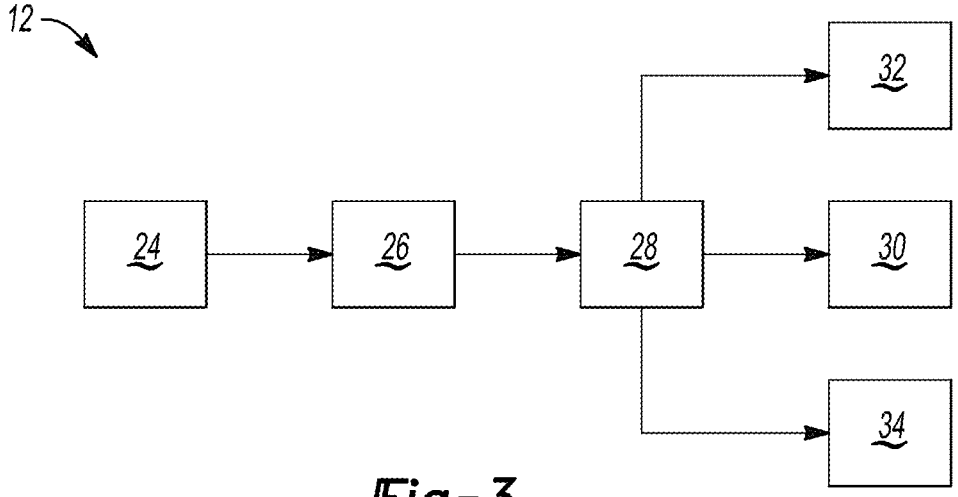
FIG. 3 is a flowchart of a method of forming the component of FIG. 1.

Referring to the Figures, wherein like reference numerals refer to like elements, a component 10 and a method 12 of forming the component 10 are shown generally in FIGS. 1 and 3, respectively. The component 10 is formed from an aluminum-iron alloy 14 that is shown generally in FIG. 2. The component 10 and method 12 may be useful for applications requiring ductile, lightweight articles that are suitable for high-temperature operating environments. In particular, the aluminum-iron alloy 14 includes niobium as an additive that imparts the aluminum-iron alloy 14 with excellent castability and ductility and imparts the component 10 with excellent strength.

Therefore, the component 10, method 12, and aluminum-iron alloy 14 may be useful for automotive vehicles such as a passenger car, sport utility vehicle, or truck. Alternatively, the component 10 and method 12 may be useful for another vehicle type, such as, but not limited to, an industrial vehicle, a recreational off-road vehicle, a train, a semi-trailer, and the like. In addition, the component 10, method 12, and aluminum-iron alloy 14 may be useful for non-automotive applications, such as, but not limited to, energy applications; aerospace applications; gas and oil exploration and refining applications; and the like.

Referring again to FIG. 2, the aluminum-iron alloy 14 for casting includes aluminum, iron, silicon, and niobium present in the aluminum-iron alloy in an amount according to formula (I):

$$(Al_3Fe_2Si)_{1-x}+xNb \quad (I)$$

wherein x is from 0.25 parts by weight to 2.5 parts by weight based on 100 parts by weight of the aluminum-iron alloy. That is, niobium may be included in the aluminum-iron alloy 14 as an additive that contributes to the excellent castability and ductility of the aluminum-iron alloy 14. Stated differently, since the aluminum-iron alloy 14 includes niobium in the specified amounts, the aluminum-iron alloy 14 is not brittle during processing. In one non-limiting example, x may be from 0.5 parts by weight to 2 parts by weight, or from 0.5 parts by weight to 1.5 parts by weight, based on 100 parts by weight of the aluminum-iron alloy 14. In another non-limiting example, x may be from 0.5 parts by weight to 0.9 parts by weight based on 100 parts by weight of the aluminum-iron alloy 14. For example, x may be 0.5 parts by weight based on 100 parts by weight of the aluminum-iron alloy 14. Alternatively, x may be 0.9 parts by weight based on 100 parts by weight of the aluminum-iron alloy 14. Further, the aluminum-iron alloy 14 may further include one or more of zirconium, molybdenum, tantalum, copper, zinc, and combinations thereof. That is, one or more of zirconium, molybdenum, tantalum, copper, zinc, and combinations thereof may strengthen grain boundaries of the aluminum-iron alloy 14 and reduce or refine grain size of the aluminum-iron alloy 14.

As described with continued reference to FIG. 2, the aluminum-iron alloy 14 may be a three-phase alloy and include an $Al_5Fe_2$ phase 16, a B2 phase 18, and a $\tau_{12}$ phase 20. In particular, the $\tau_{12}$ phase 20 may be a main phase of the aluminum-iron alloy 14. The aluminum-iron alloy 14 may have a density of from 4.5 g/cm$^3$ to 5.5 cm$^3$, e.g., 4.6 g/cm$^3$ or 4.7 g/cm$^3$ or 4.8 g/cm$^3$ or 4.9 g/cm$^3$ or 5.0 g/cm$^3$ or 5.1 g/cm$^3$ or 5.2 g/cm$^3$ or 5.4 g/cm$^3$. Further, the aluminum-iron alloy 14 may have a melting point of from 995° C. to 1,015° C., e.g., 1,000° C. or 1,005° C. or 1,010° C.

The $Al_5Fe_2$ phase 16 and the B2 phase 18 may be secondary phases of the aluminum-iron alloy 14, and the $Al_5Fe_2$ phase 16 may be detrimental. In particular, an increased amount of niobium present in the aluminum-iron alloy 14 may reduce an amount of the $Al_5Fe_2$ phase 16 present in the aluminum-iron alloy 14. More specifically, the niobium may be present in the aluminum-iron alloy 14 as a precipitate 22 (FIG. 2) that surrounds the $\tau_{12}$ phase 20 and suppresses nucleation and growth of the $Al_5Fe_2$ phase 16 within the aluminum-iron alloy 14. That is, the niobium precipitate 22 may form a shield around the $\tau_{12}$ phase 20 to block or diminish diffusion of the detrimental $Al_5Fe_2$ phase 16 within the aluminum-iron alloy 14. As such, the niobium precipitate 22 may provide the aluminum-iron alloy 14 with excellent castability and ductility to form components 10 that are lightweight and suitable for high-temperature applications.

Referring again to FIG. 1, the component 10 may be cast from the aluminum-iron alloy 14. That is, as set forth in more detail below, the component 10 may be cast by pouring or depositing molten aluminum-iron alloy 14 into a cavity defined by a mold (not shown) and then solidifying 28 (FIG. 3) the molten aluminum-iron alloy 14. The component 10 may be an article suitable for applications requiring lightweight components 10 operable in high-temperature environments. For example, although not intended to be limiting, the component 10 may be a brake rotor for a vehicle as shown in FIG. 1. Alternatively, the component 10 may be another article formed from the aluminum-iron alloy 14.

Referring now to FIG. 3, the method 12 of forming the component 10 includes forming 24 the aluminum-iron alloy 14 including aluminum, iron, silicon, and niobium according to formula (I) set forth above. That is, the aluminum-iron alloy 14 includes niobium as an additive such that x is from 0.25 parts by weight to 2.5 parts by weight based on 100 parts by weight of the aluminum-iron alloy 14. In one non-limiting embodiment, forming 24 the aluminum-iron alloy 14 may include combining aluminum, iron, silicon, and niobium according to formula (I) such that x is from 0.5 parts by weight to 0.9 parts by weight based on 100 parts by weight of the aluminum-iron alloy 14.

The method 12 also includes melting 26 the aluminum-iron alloy 14 to form a melt. That is, the method 12 may include pouring or depositing the aluminum-iron alloy 14 into the cavity defined by the mold (not shown) and melting 26 the aluminum-iron alloy 14. For example, melting 26 may include heating the aluminum-iron alloy 14 up to from 1,100° C. to 1,300° C., e.g., up to 1,150° C. or 1,200° C. or 1,250° C. in one of air and an inert environment.

As described with continued reference to FIG. 3, the method 12 also includes solidifying 28 the melt to form an ingot. That is, although not shown, the ingot may be shaped according to a shape of the mold cavity and may be in raw or bulk form suitable for additional processing or shaping. In one embodiment, solidifying 28 may include furnace cooling the melt. That is, solidifying 28 may include cooling the melt in a furnace at decreasing or variable temperatures or rates. In another embodiment, solidifying 28 may include air cooling the melt at decreasing or variable temperatures or rates.

The method 12 further includes annealing 30 the ingot. Annealing 30 may occur at from 800° C. to 1,000° C., e.g., 825° C. or 850° C. or 875° C. or 900° C. or 925° C. or 950° C. or 975° C. for from 1 hour to 24 hours, e.g., for 2 hours or 4 hours or 6 hours or 8 hours or 10 hours or 12 hours or 14 hours or 16 hours or 18 hours or 20 hours or 22 hours. Annealing 30 may also occur in one of a vacuum and an inert atmosphere. Such annealing 30 may heat the ingot and cool the ingot relatively slowly to remove internal stresses in the ingot and thereby toughen the ingot.

Concurrent to annealing 30, the method 12 further includes reducing 32 a detrimental amount of a secondary phase of the aluminum-iron alloy 14, e.g., the $Al_5Fe_2$ phase 16. Similarly, concurrent to reducing 32, the method 12 includes refining 34 a grain structure of a main phase, i.e., the $\tau_{12}$ phase 20, of the aluminum-iron alloy 14 to thereby form the component 10. That is, the niobium present in the aluminum-iron alloy 14 in the aforementioned amount may refine or alter the microstructure of the $\tau_{12}$ phase 20 and prevent the detrimental amount of the $Al_5Fe_2$ phase 16 from diffusing through the aluminum-iron alloy 14. That is, the niobium may from a shield around the elements of the $\tau_{12}$ phase 20 and suppress nucleation, growth, diffusion, and migration of the secondary, detrimental $Al_5Fe_2$ phase 16.

Therefore, the component 10, aluminum-iron alloy 14, and method 12 may be useful for applications requiring ductile, lightweight components 10 that are suitable for high-temperature operating environments. In particular, the aluminum-iron alloy 14 includes niobium as an additive. The niobium imparts the aluminum-iron alloy 14 with excellent castability and ductility and imparts the component 10 with excellent strength and high-temperature suitability. Further, since niobium is generally a relatively expensive element, the aluminum-iron alloy 14 limits niobium to the aforementioned small amount. In addition, an iron-niobium master alloy instead of pure niobium may be used as a niobium source for the aluminum-iron alloy 14 to further lower raw material costs. Therefore, the aluminum-iron alloy 14 and method 12 are cost effective for producing the component 10.

While the best modes for carrying out the disclosure have been described in detail, those familiar with the art to which this disclosure relates will recognize various alternative designs and embodiments for practicing the disclosure within the scope of the appended claims.

What is claimed is:

1. An aluminum-iron alloy for casting, the aluminum-iron alloy comprising:

aluminum, iron, silicon, and niobium present in the aluminum-iron alloy in an amount according to formula (I):

$$(Al_3Fe_2Si)(1-x)+xNb \quad (I)$$

wherein numeral 3 and numeral 2 set forth an atomic ratio of aluminum and iron;

wherein x is from 0.5 parts by weight to 0.9 parts by weight based on 100 parts by weight of the aluminum-iron alloy; and zinc.

2. The aluminum-iron alloy of claim 1, wherein x is 0.5 parts by weight based on 100 parts by weight of the aluminum-iron alloy.

3. The aluminum-iron alloy of claim 1, wherein x is 0.9 parts by weight based on 100 parts by weight of the aluminum-iron alloy.

4. The aluminum-iron alloy of claim 1, wherein the aluminum-iron alloy is a three-phase alloy and includes an $Al_5Fe_2$ phase, a B2 phase, and a $\tau_{12}$ phase; wherein numeral 5 and numeral 2 set forth an atomic ratio of aluminum and iron.

5. The aluminum-iron alloy of claim 4, wherein the $\tau_{12}$ phase is a main phase of the aluminum-iron alloy.

6. The aluminum-iron alloy of claim 5, wherein aluminum-iron alloy has a density of from 4.5 g/cm$^3$ to 5.5 g/cm$^3$.

7. The aluminum-iron alloy of claim 6, wherein the aluminum-iron alloy has a melting point of from 995° C. to 1,015° C.

8. The aluminum-iron alloy of claim 4, wherein the $Al_5Fe_2$ phase and the B2 phase are secondary phases of the aluminum-iron alloy.

9. The aluminum-iron alloy of claim 4, wherein an increased amount of niobium present in the aluminum-iron alloy reduces an amount of the $Al_5Fe_2$ phase present in the aluminum-iron alloy.

10. The aluminum-iron alloy of claim 4, wherein the niobium is present in the aluminum-iron alloy as a precipitate that surrounds the $\tau_{12}$ phase and suppresses nucleation and growth of the $Al_5Fe_2$ phase within the aluminum-iron alloy.

11. The aluminum-iron alloy of claim 1, wherein the aluminum-iron alloy further includes one or more of zirconium, molybdenum, tantalum, and combinations thereof.

12. A component cast from the aluminum-iron alloy of claim 1.

* * * * *